US005553435A

United States Patent [19]

Eickhoff

[11] Patent Number: 5,553,435

[45] Date of Patent: Sep. 10, 1996

[54] BLOCK SPACER SYSTEM

[76] Inventor: Jon H. Eickhoff, 2330 Plymouth La., Kalamazoo, Mich. 49008

[21] Appl. No.: 353,435

[22] Filed: Dec. 9, 1994

[51] Int. Cl.[6] ..... E04B 1/21

[52] U.S. Cl. ..... 52/698; 405/262; 405/284; 52/715; 52/603; 52/562; 52/379; 52/309.12

[58] Field of Search ..... 52/698, 715, 379, 52/426, 603, 606, 562, 582.1, 309.9, 309.12; 405/262, 284

[56] References Cited

U.S. PATENT DOCUMENTS

| | | | |
|---|---|---|---|
| 2,213,355 | 9/1940 | Woodworth | 52/562 X |
| 3,772,842 | 11/1973 | Barbera | 52/562 X |
| 4,226,061 | 10/1980 | Day, Jr. | 52/426 X |
| 4,604,843 | 8/1986 | Ott et al. | 52/562 X |
| 4,866,891 | 9/1989 | Young | 52/309.12 X |
| 4,884,382 | 12/1989 | Horobin | 52/309.12 X |
| 4,924,641 | 5/1990 | Gibbar, Jr. | 52/309.12 X |
| 4,998,397 | 3/1991 | Orton | 52/379 X |
| 5,224,801 | 7/1993 | Quaney | 405/284 X |
| 5,370,480 | 12/1994 | Quaney | 405/284 |
| 5,372,461 | 12/1994 | Nanayakkara | 405/284 X |

FOREIGN PATENT DOCUMENTS

| | | | |
|---|---|---|---|
| 0144004 | 6/1920 | United Kingdom | 52/562 |

*Primary Examiner*—Wynn E. Wood

*Attorney, Agent, or Firm*—Flynn, Thiel, Boutell & Tanis, P.C.

[57] ABSTRACT

A block spacer system for locating and supporting a plurality of blocks arranged end to end in a lateral direction so as to form vertically adjacent lower and upper tiers of a mortarless wall structure. The spacer system includes horizontal and vertical block spacer members where the horizontal block spacer member is secured to a downwardly adjacent block of the lower tier and has a frontal support member proximate a front face of the downwardly adjacent block of the lower tier. The frontal support member has an upstanding locator wall surface facing rearwardly for abutment with the front face of the adjacent block of the upper tier to define a forward locator position, offset the upper tier rearwardly and prevent forward displacement of the upper tier relative to the lower tier. In addition, a spacer web on the forward locator wall surface defines a lateral locator position.

31 Claims, 4 Drawing Sheets

BLOCK SPACER SYSTEM

FIELD OF THE INVENTION

The invention generally relates to a block spacer system for locating and supporting a plurality of blocks which are arranged end to end in a lateral direction so as to form vertically adjacent lower and upper tiers of a mortarless block wall, and more particularly, relates to a block spacer system having horizontal block spacer members provided with drip rails which are arranged end to end along a front face of the lower tier to enclose the horizontal joints between the upper and lower tiers as well as define a forward locator position for the upper tier, and also having vertical spacer members between the drip rails so as to enclose the vertical joints formed between laterally adjacent blocks.

BACKGROUND OF THE INVENTION

Block spacers are typically used to construct retaining walls or the like and maintain the blocks of lower tiers and upper tiers in alignment without the necessity of using mortar. An example of a support member for use in laying concrete blocks is disclosed in U.S. Pat. No. 4,998,397 wherein the support member comprises an elongate body piece having appendages projecting downwardly which are positioned so as to abut against the rear wall of a lower tier and appendages projecting upwardly which receive the rear wall of the upper tier therebetween to maintain the upper and lower tiers in alignment. The elongate body piece has a length extending across the blocks and a width which is relatively narrow in comparison to the length of the elongate body piece.

Such an arrangement does not serve to enclose either the horizontal joints between the upper and lower tiers or the vertical joints between laterally adjacent blocks. Also, the arrangement does not include a horizontal support member having a drip rail disposed at the front end of the body piece which facilitates removal of precipitation and defines front and lateral locator positions for the upper tiers.

It is desirable, therefore, to provide a block spacer system which permits construction of a retaining wall without the use of mortar or specialized tools. It further is desirable to enclose the horizontal and vertical joints of the mortarless wall and to provide a drip rail which facilitates removal of precipitation and defines a locator position for a front face of the upper tier relative to the front face of the lower tier. It also is desirable to provide a spacer web extending rearwardly from the drip rail to define a lateral locator position for opposing end faces of laterally adjacent blocks of the upper tier.

SUMMARY OF THE INVENTION

The invention relates to a block spacer system for locating and supporting a plurality of blocks arranged end to end in a lateral direction so as to form vertically adjacent lower and upper tiers of a mortarless wall structure. The block spacer system includes vertical and horizontal block spacer members where the horizontal block spacer member is secured to a downwardly adjacent block of the lower tier. The horizontal block spacer member has a frontal support member proximate a front face of the downwardly adjacent block of the lower tier and has an upstanding locator wall surface facing rearwardly for abutment with the front face of the adjacent block of the upper tier. The locator wall surface serves to define a forward locator position, offset the upper tier rearwardly and prevent forward displacement of the upper tier relative to the lower tier.

The frontal support member also includes a lateral locator web which projects rearwardly from the upstanding locator wall and is adapted to be disposed between opposing ends of laterally adjacent blocks of the upper tier. The lateral locator web serves to define a lateral locator position for the blocks.

The vertical spacer members each have a vertical spacer which seats within the vertical joint between the opposing ends of the blocks much like the lateral locator web. The vertical spacer webs engage the frontal support members above and below each tier to enclose the vertical joints. With this block spacer system, the aforesaid objects of the invention are satisfied.

BRIEF DESCRIPTION OF THE DRAWINGS

The invention will be discussed in greater detail in connection with the following exemplary embodiments. In the drawings.

DESCRIPTION OF THE PREFERRED EMBODIMENTS

Figure 1:
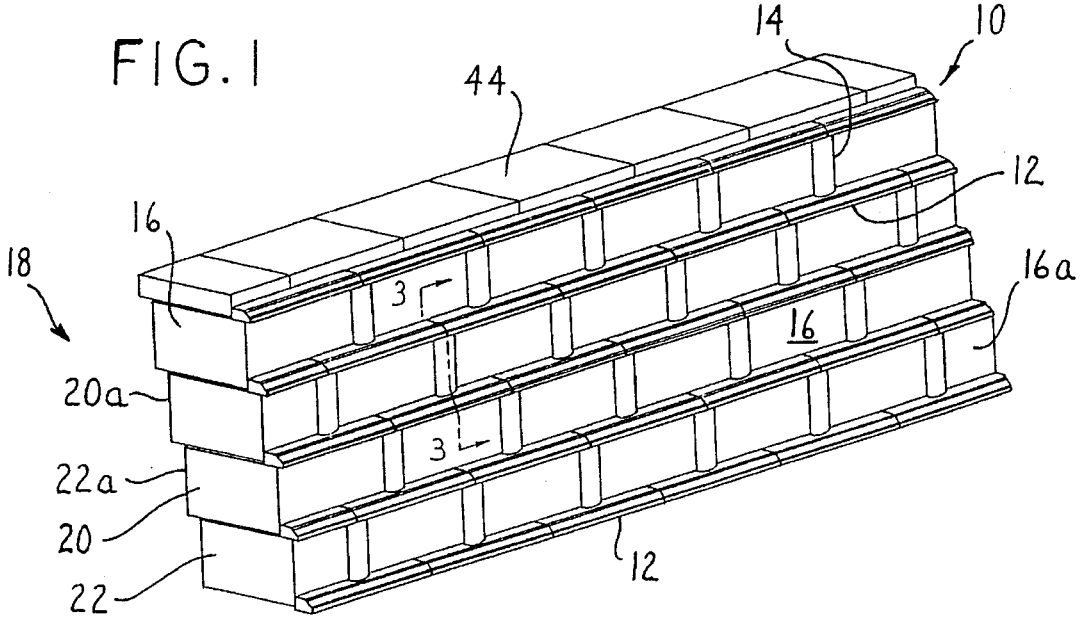
FIG. 1 is a pictorial view illustrating a plurality of blocks arranged so as to form vertically adjacent tiers of a mortarless wall structure in combination with the spacer system of the invention which includes horizontal and vertical spacer members.

Referring to FIG. 1, the block spacer system of the invention generally is designated by reference numeral 10. The block spacer system 10 includes a plurality of horizontal block spacer members 12 adapted to be arranged end to end and a plurality of vertical spacer members 14. When assembled, the horizontal block spacer members 12 and vertical spacer members 14 serve to locate and support a plurality of blocks 16 arranged end to end in a lateral direction so as to form a mortarless wall structure of vertically adjacent tiers, pairs of which are referred to herein as upper and lower tiers 20 and 22, or 20*a* and 22*b*, etc. for successive upwardly adjacent pairs of tiers.

Figure 7:
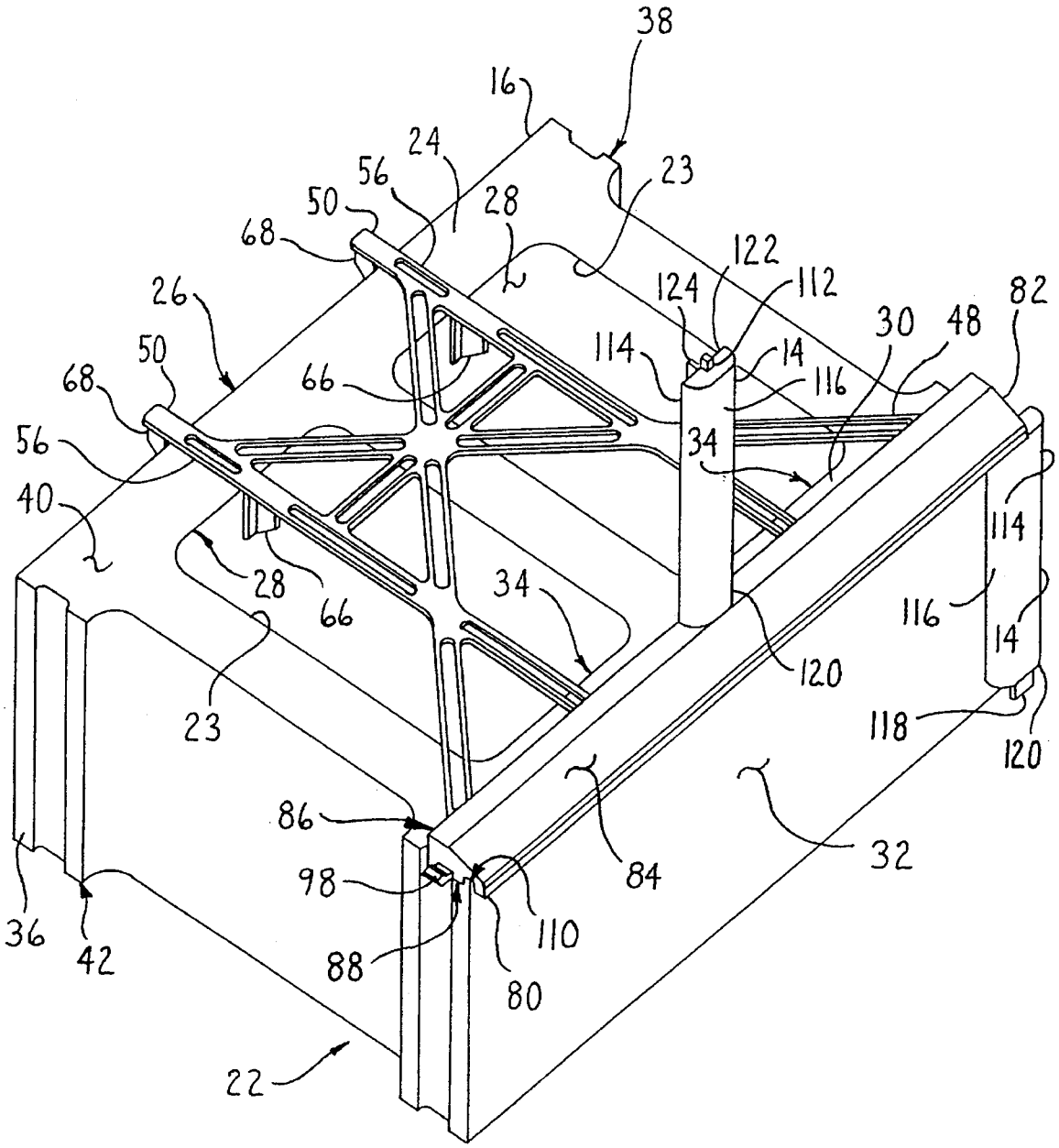
FIG. 7 is a perspective view of one horizontal spacer member positioned on top of one block and two vertical spacer members laterally staggered and engaged with the horizontal spacer member.

More particularly each of the blocks 16 with which the block spacer system 10 is to be used are typically made of concrete or the like. Referring to FIG. 7, the blocks 16 typically are formed with cavities 23 which at least open upwardly. Due to the cavities 23, a rear block wall 24 is formed which is defined by a rear face 26 of the block 16 and a forwardly facing inner face 28, and a front block wall 30 is formed which is defined by a front face 32 and a rearwardly facing inner face 34. It should be appreciated that the blocks 16 may be formed solid without the cavities 23 so that each block 16 only includes the front face 32 and the rear face 26. Each block 16 also is formed with opposite end faces 36 and 38, a top surface 40 and a bottom surface 42.

As illustrated in FIG. 1, the blocks 16 of the wall structure 18 preferably are arranged in an overlapping arrangement in a lateral direction and each tier is offset a predetermined spaced apart distance rearwardly in the vertical direction. At the ends of each tier, half blocks 16*a* may be provided as necessary. To form a cap for the wall structure 18, a plurality of solid rectangular cap blocks 44 of known construction are provided.

Referring to the block spacer system 10 of the invention, preferably all parts described herein are molded integrally from plastic resin or the like although it should be recognized that other materials and constructions may be used so long as the desired components and arrangement therefor are provided.

Figure 2:
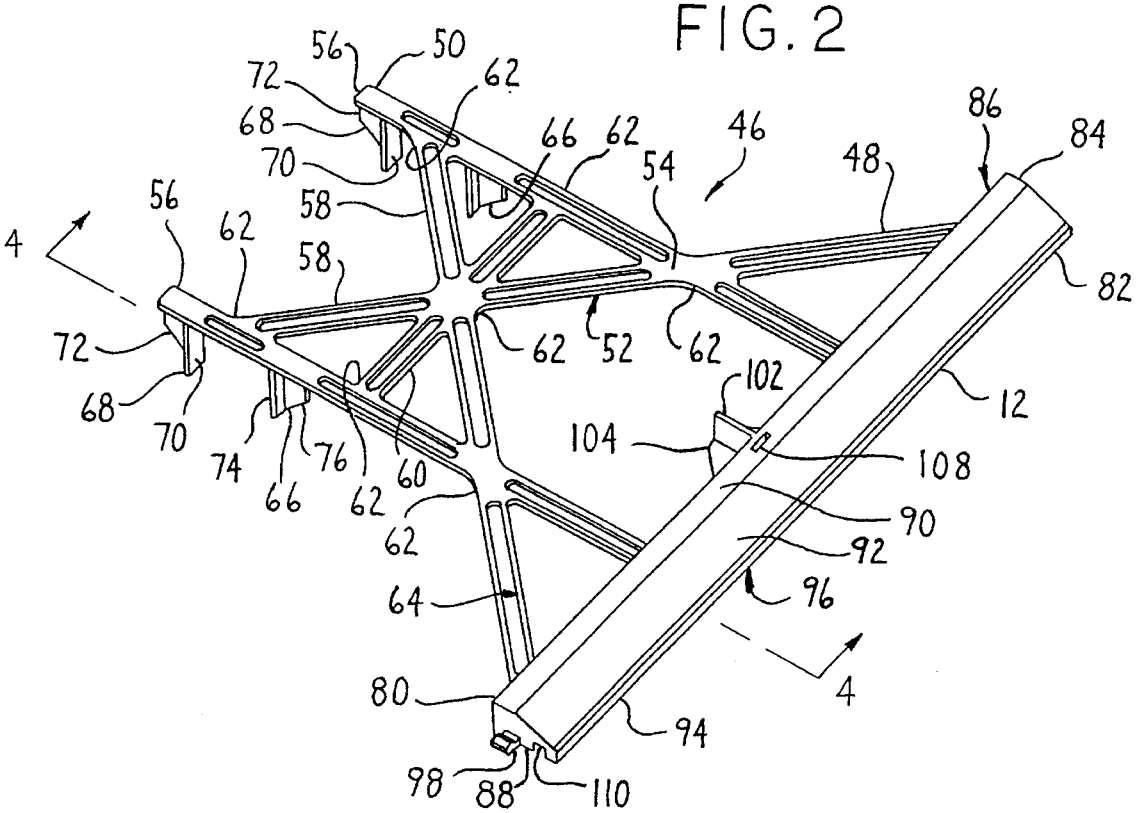
FIG. 2 is a perspective view illustrating the horizontal spacer member.
Figure 3:
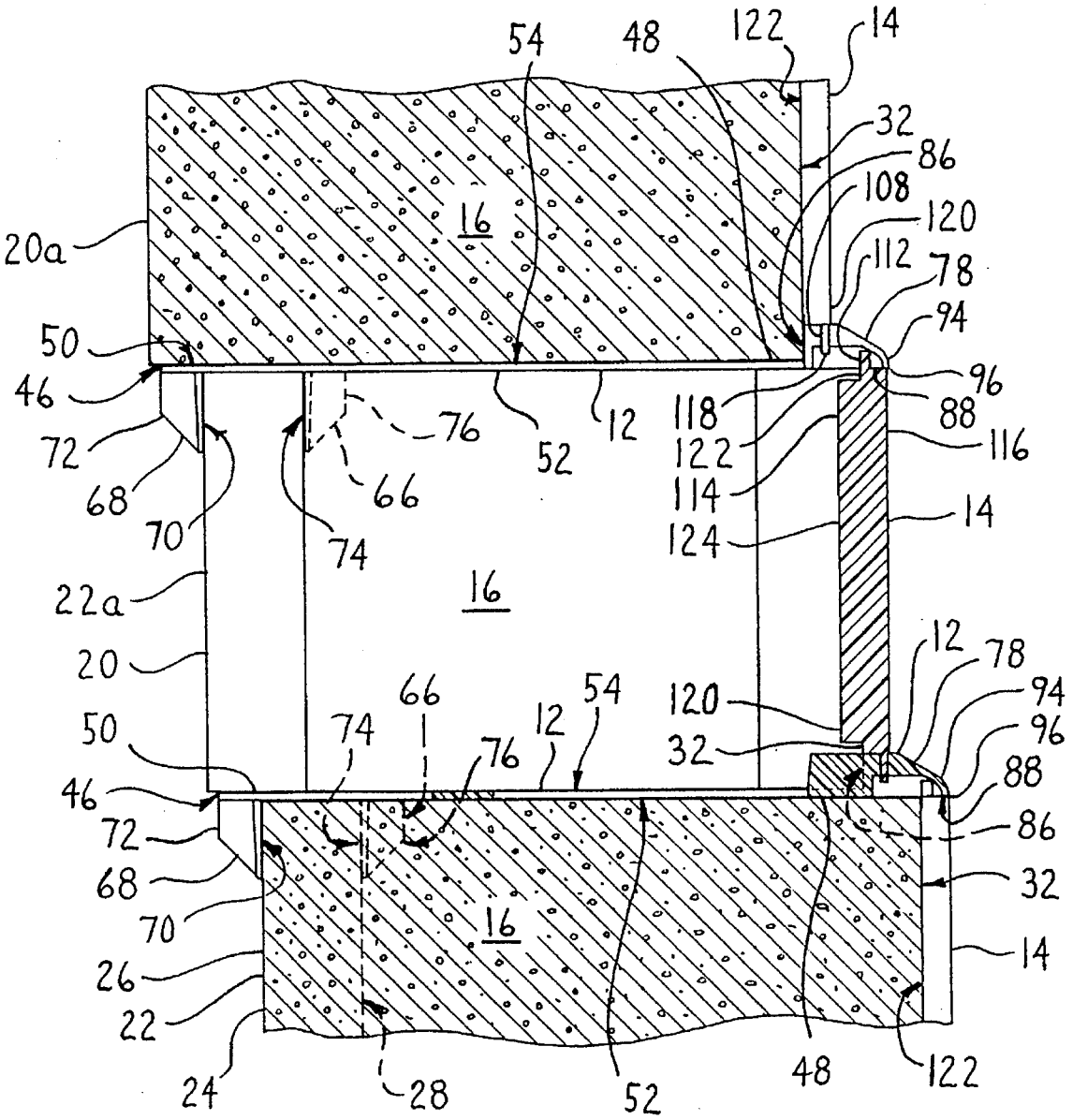
FIG. 3 is a side elevational view in cross-section illustrating the horizontal spacer members and vertical spacer members positioned in place with the blocks of vertically adjacent tiers as viewed in the direction of line 3—3 of FIG. 1.
Figure 4:
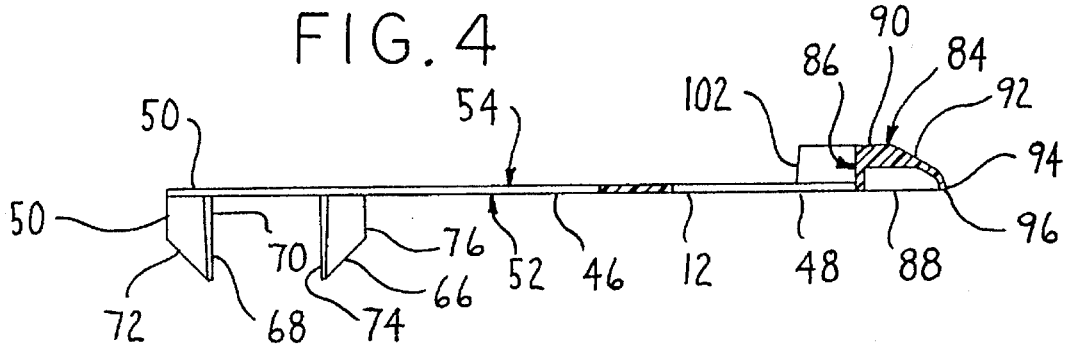
FIG. 4 is a side elevational view in cross-section illustrating the horizontal spacer member as viewed in the direction of line 4—4 of FIG. 2.

Referring to FIGS. 2, 3 and 4, each horizontal block spacer 12 includes a base support structure 46. The base support structure 46 includes a forward end 48 adapted to be positioned proximate the front face 32 of one of the downwardly adjacent blocks 16 of the lower tier 22 and a rear end 50 adapted to be positioned proximate the rear face 26 of the downwardly adjacent block 16. The base support structure 46 also includes a bottom surface 52 adapted to be positioned on top of at least one of the downwardly adjacent blocks 16 of the lower tier 22 and a top surface 54 adapted to support at least one of the upwardly adjacent blocks 16 of the upper tier 22.

Referring to FIG. 2, the base support structure 46 preferably comprises two elongate members 56 extending rearwardly, two diagonal members 58 extending in a diagonal direction, and a cross member 60 perpendicular to the elongate members 56. Said members 56, 58 and 60 are integrally formed one with the other at a plurality of locations 62 where they intersect. Each of the cross members 56, 58 and 60 are formed with their bottom surfaces 52 being coplanar and also include elongate slots 64 formed therein.

As FIGS. 2, 3 and 4 illustrate, each horizontal block spacer member 12 also includes position determining or anchoring means for anchoring the base support structure 46 relative to the downwardly adjacent block 16 of the lower tier 22 for preventing forward displacement of the block spacer member 12. The preferred anchoring means includes two pairs of downwardly projecting front and rear anchoring projections 66 and 68 which are integrally formed with the base support structure 46 proximate the rear end 50.

The rear anchoring projection 68 has a T-shaped cross-section and includes a wall surface 70 which faces forwardly for abutment against the rear face 26 of the downwardly adjacent block 16 and a bracing web 72 oriented perpendicular to the wall surface 70. Such an arrangement prevents forward displacement of the block spacer member 12.

When the blocks 16 are provided with the cavity 23, the forward anchoring projection 66 also may be provided which, as illustrated in FIGS. 3 and 7, is located a spaced apart distance from the rear anchoring projection 68 so as to accommodate the thickness of the rear block wall 24. The forward anchoring projection 66 is formed similar to the rear anchoring projection 68 in that it projects downwardly and has a T-shaped cross-section so as to provide a wall surface 74 facing rearwardly for abutment against the inner face 28 of the cavity 23. A bracing web 76 also is provided perpendicular to the wall surface 74.

As FIGS. 2 and 7 illustrate, two pairs of front and rear anchoring projections 66 and 68 are provided, each pair being integrally formed with the rear end 50 of one of the elongate members 56 so as to provide a two point engagement with the rear block wall 24 when positioned on the downwardly adjacent block 16 of the lower tier 22. It also should be recognized that where the block 16 is solid and the cavities 23 are not present, the rear anchoring projection 68 need only be provided which serves to at least prevent the forward displacement of the horizontal block spacer members 12.

Each horizontal block spacer member 14 also includes a frontal support member or drip rail 78. The frontal support member 78 is defined by a first end 80 and a second end 82, a frontal surface 84, an upstanding locator wall surface 86 and a bottom surface 88, at least a portion of which is coplanar with the bottom surface 52 of the base support structure 46 as seen in FIG. 4.

As FIGS. 2, 3 and 4 illustrate, the locator wall surface 86 is integrally formed with the base support structure 46 at the forward ends 48 of the elongate and diagonal members 56 and 58. The locator wall surface 86 faces rearwardly for abutment with the front face 32 of the adjacent block 16 of the upper tier 20. The locator wall surface 86 serves to define a forward locator position for the upper tier 20 as illustrated in FIG. 3. To offset the upper tier 20 rearwardly relative to the lower tier 22, the locator wall surface 86 is adapted to be positioned a spaced apart distance rearwardly from the front face 32 of the downwardly adjacent block 16 of the lower tier 22. With such an arrangement, forward displacement of the upwardly adjacent block 16 of the upper tier 20 relative to the downwardly adjacent block 16 of the lower tier 22 is prevented.

As seen in FIGS. 2 and 4, the frontal surface 84 of the frontal support member 78 preferably is defined by a top face 90, a sloped face 92, and a front face or surface 94. The sloped face 92 is provided to facilitate removal of precipitation away from the front face 32 of the upwardly adjacent block 16 of the upper tier 20 as seen in FIGS. 1 and 3.

Referring to FIGS. 2, 3 and 4 the frontal support member 78 also includes a front edge 96 defined by the bottom surface 88 and the front face 94. Preferably the front edge 96 is adapted to extend beyond the front face 32 of the downwardly adjacent block 16 of the lower tier 22 so as to form an overhang as illustrated in FIGS. 3, 5 and 7 to further facilitate removal of precipitation or the like.

To engage opposing ends of laterally adjacent frontal support members 78 when constructing the mortarless wall structure 18, each frontal support member 78 is provided with engagement means. Preferably, the engagement means comprises an L-shaped tab 98 extending outwardly in the lateral direction from the first end 80 of the frontal support member 78 as seen in FIGS. 2 and 7. Opposite the first end 80, the second end 82 is provided with a slot 100 (not illustrated in FIG. 2) which is adapted to receive and lockingly engage with the corresponding tab 98 of the first end 80 of the laterally adjacent frontal support member 78. The tab 98 and slot 100 are illustrated in locking engagement in FIGS. 5 and 6. By engaging opposing ends 80 and 82 of laterally adjacent frontal support members 78, horizontal joints between upper and lower tiers 20 and 22 of the wall structure 18 are enclosed.

Figure 5:
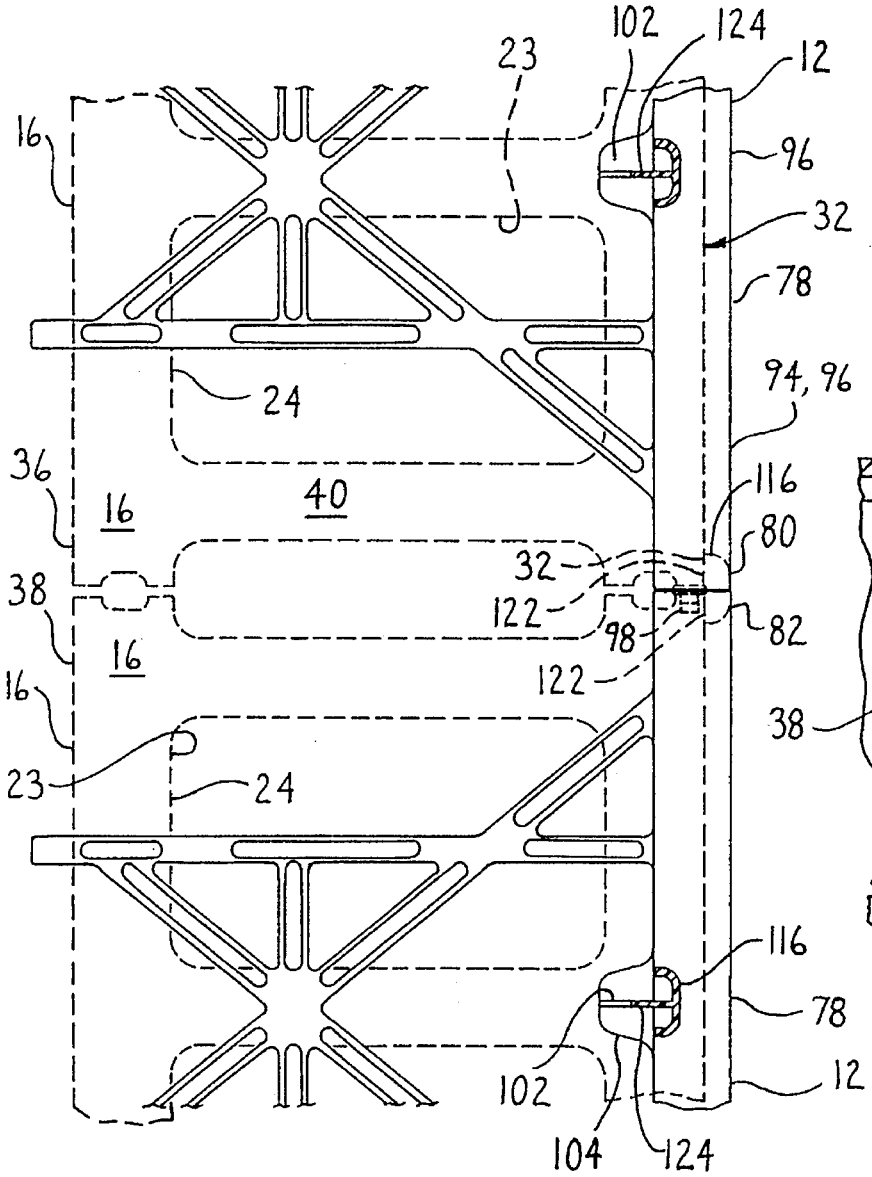
FIG. 5 is a top sectional view illustrating the horizontal and vertical spacer members arranged on top of a lower tier of the blocks.

To facilitate construction of the overlapping arrangement of the blocks 16 illustrated in FIG. 1, each frontal support member 78 is provided with a lateral locator web 102 projecting rearwardly from the locator wall surface 86 intermediate the first and second ends 80 and 82 as illustrated in FIGS. 2 and 5. A planar spacer plate 104 is integrally formed with the lateral locator web 102 to provide support to bottom surfaces 42 of the blocks 16 of the upper tier 20.

Figure 6:
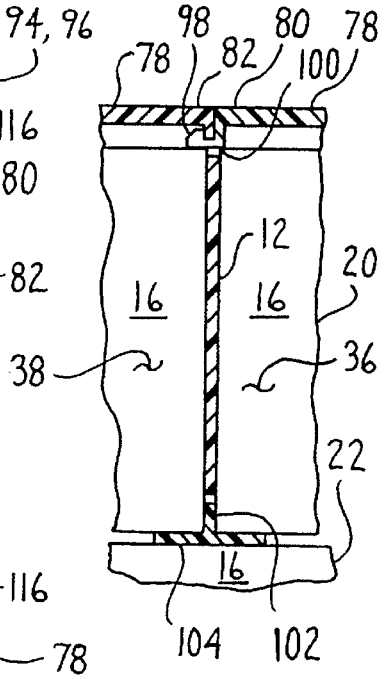
FIG. 6 is a front cross-sectional view illustrating a lateral locator web disposed between two laterally adjacent blocks, a spacer web of one of the vertical spacer members disposed between opposing ends of laterally adjacent blocks and opposing ends of laterally adjacent horizontal spacer members engaged one with the other.

More particularly, the lateral locator web 102 is adapted to be between and abut against the opposing end faces 36 and 38 of two laterally adjacent blocks 16 of the upper tier 20 as illustrated in FIG. 6. Such an arrangement serves to define a lateral locator position for the blocks 16 of the upper tier 20 relative to the downwardly adjacent blocks 16 of the lower tier 22 and provide the overlapping arrangement illustrated in FIG. 1. The location at which the lateral locator web 102 is formed intermediate the first and second ends 80 and 82 of the frontal support member 78 defines the extent of overlap.

To facilitate engagement of the horizontal block spacer members 12 with the vertical spacer members 14 as seen in FIG. 1, each frontal support member 78, as illustrated in FIG. 2, includes an projection receiving opening 108 formed in the top face 90 which is aligned with respect to the lateral locator web 102. Each frontal support member 78 also includes engagement notches 110 which open each toward the bottom surfaces 88 and the first and second ends 80 and 82 of the frontal support member 78, only one of which is illustrated in FIG. 2. The engagement notches 110 are formed with the first and second ends 80 and 82 such that one of the engagement notches 110 formed in the first end 80 of one frontal support member 78 is in alignment with the opposing engagement notch 110 formed in the second end 82 of a laterally adjacent frontal support member 78.

Referring to FIGS. 3 and 7, each vertical spacer member 14 includes an upper projection 112 on an upper end 114 thereof which is adapted to be seated within the downward facing opening formed by opposing pairs of engagement notches 110. The upper projection 112 is located on the upper end 114 so that when engaged within the engagement notches 110, a front face 116 of the vertical spacer member 14 is aligned vertically coplanar with the front face 94 and the front edge 96 of the upwardly adjacent frontal support member 78 as illustrated in FIG. 3.

Each vertical spacer member 14 also includes a lower projection 118 at a lower end 120 thereof as seen in FIGS. 3 and 7 which is adapted to engage the corresponding projection receiving opening 108 of the downwardly adjacent frontal support member 78. The lower projection 118 is located such that a rear face 122 of the vertical spacer member 14 is positioned vertically coplanar with the locator wall surface 86 of the downwardly adjacent frontal support member 78. When the rear face 122 is aligned coplanar with the locator wall surface 86, the rear face 122 abuts against the front faces 32 of the rearwardly adjacent blocks 16 as seen in FIG. 3.

Referring to FIGS. 3, 5 and 7, each vertical spacer member 14 also includes a vertical spacer web 124 which projects rearwardly from the rear face 122 thereof. The vertical spacer web 124 is arranged in such a manner that when the lower projection 118 is received within the downwardly adjacent projection receiving opening 108 and the upper projection 112 is received within the upwardly adjacent engagement notches 110, the vertical spacer web is in vertical alignment with the lateral locator web 102 of the downwardly adjacent frontal support member 78 as seen in FIG. 6. In such a manner, the vertical spacer members 14 serve to enclose vertical joints at opposing ends of laterally adjacent blocks 16.

In operation, a first tier of blocks 16 are laid end to end in the lateral direction to form a first lower tier 22 for the wall structure 18. Preferably, this first lower tier 22 is provided on a level surface (not illustrated).

Thereafter, a plurality of the horizontal block spacer members 12 are positioned each with the frontal support member 78 thereof arranged end to end on the top surface 40 of the plurality of laterally adjacent blocks 16 as illustrated in FIGS. 1, 5 and 6. In positioning one frontal support member 78 laterally adjacent to another frontal support member 78, the front and rear anchoring projections 66 and 68 are dropped over the rear block wall 24 to prevent forward and rearward movement of the horizontal block spacer members 12. At the same time, the slot 100 of a second end 82 of one frontal support member 78 is engaged with the tab 98 of the first end 80 of the laterally adjacent frontal support 78 so as to lockingly engage the laterally adjacent frontal support members 78 one with the other. Such an operation is repeated along the entire length of the lower tier 22.

When the lower tier 22 of blocks 16 has been laid and the horizontal block spacer members 16 placed thereon, another plurality of blocks 16 are laid on top of the blocks 16 of the lower tier 22 to form an upper tier 20. In positioning the blocks 16 of the upper tier 20, the front faces 32 of the blocks 16 are seated so as to abut against the locator wall surface 86 which defines the forward locator position for the upper tier 22. At the same time, the opposing end faces 36 and 38 of laterally adjacent blocks 16 are positioned so as to abut against the lateral locator web 102 which defines the lateral locator position for the blocks 16 of the upper tier 22.

Thereafter, the vertical spacer members 14 are positioned in place by seating the lower projection 118 of the lower end 120 thereof into the projection receiving opening 108 of the downwardly adjacent frontal support member 78 whereby the vertical spacer web 124 of the vertical spacer member 14 inserts into the vertical joint between the opposing end faces 36 and 38 of laterally adjacent blocks 16. Once positioned, the upper tier 20 now serves as a lower tier **22*a* as illustrated in FIGS. 1 and 3, at which time another plurality of horizontal block spacer members 12 are deposited in succession on the top surface 40 of the laterally adjacent blocks 16. In positioning the frontal support members 78 of the horizontal block spacer members 12 on top of the lower tier 22*a*, the opposing engagement notches 110 are aligned and thereafter seated on top of the upper projection 112 of a downwardly adjacent vertical spacer member 14. This operation is repeated to construct a wall structure 18** of any desired height and length.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mortarless wall structure, comprising:

a plurality of blocks arranged end to end in a lateral direction so as to form a lower tier and an upwardly adjacent upper tier of the mortarless wall structure, each said block of said upper and lower tiers having a rear face facing in a rearward direction transverse to said lateral direction and a front face facing in a forward direction opposite said rearward direction, said front faces of said blocks defining an outward facing surface of the mortarless wall structure; and a block spacer system for locating and supporting said blocks having at least one block spacer member, said block spacer member comprising:

a base support member having a first end positioned toward said front face of said blocks of said wall structure in said forward direction, a second end positioned in said rearward direction, a bottom surface positioned on top of at least one of said blocks of said lower tier downwardly adjacent thereto, and a top surface adapted to support at least one of said blocks of said upper tier upwardly adjacent thereto;

position determining means between said first and second ends of said base support member for operatively interconnecting with said downwardly adjacent block of said lower tier for preventing at least forward displacement of said base support member when positioned on said lower tier; and a frontal support member at said first end of said base support member having a first end and a second end which are oriented proximate said front face of said downwardly adjacent block of said lower tier when said position determining means is in interconnecting relation with downwardly adjacent said block, said frontal support member having a front surface, a bottom surface, and an upstanding locator wall surface which are disposed forwardly of said adjacent block of said upper tier, said upstanding locator wall facing rearwardly for abutment with said front face of said adjacent block of said upper tier to define a forward locator position for said upper tier and prevent forward displacement of said upper tier relative to said lower tier, at least a portion of said bottom surface of said frontal support member extending coplanar from said bottom surface of said base support member.

2. The mortarless wall structure as defined in claim 1, wherein said front surface of said frontal support member is sloped downwardly in said forward direction and extends a predetermined distance beyond said downwardly adjacent block to facilitate drainage of precipitation away from said front face of said upwardly adjacent block of said upper tier.

3. The mortarless wall structure as defined in claim 1, wherein said upstanding locator wall surface is disposed rearwardly a predetermined distance from said front face of said downwardly adjacent block to offset said upper tier rearwardly with respect to said lower tier, said frontal support member having a front edge defined by said bottom surface and said front surface thereof wherein said front edge is adapted to be positioned forwardly a predetermined distance away from said front face of said downwardly adjacent block of said lower tier to form an overhang.

4. The mortarless wall structure as defined in claim 1, wherein said position determining means comprises at least one first projection which projects downwardly from said bottom surface of said base support-member, said first projection being disposed rearwardly of said downwardly adjacent block of said lower tier and having a surface facing said forward direction for abutting against said rear face of said downwardly adjacent block.

5. The mortarless wall structure as defined in claim 4, wherein said downwardly adjacent block is formed with an inner cavity therein which opens upwardly to form a rear block wall of predetermined width defined by said rear face thereof and a forward facing inner face, said position determining means comprising at least one second projection which projects downwardly from said bottom surface and is disposed within said inner cavity forwardly of said forward facing inner face, said second projection having a surface which faces said rearward direction for abutment against said inner face of said rear block wall and is positioned a spaced apart distance from said first projection so as to permit engagement of said rear block wall therebetween.

6. The mortarless wall structure as defined in claim 5, wherein said position determining means comprises two pairs of said first and second projections, each pair spaced apart from said other pair in said lateral direction and adapted to each engage said rear block wall.

7. The mortarless wall structure as defined in claim 1, wherein said base support member comprises first and second elongate transverse members disposed intermediate said first and second ends of said frontal support member and extending from said frontal support member in said rearward direction and first and second diagonal members extending from proximate said first and second ends of said frontal support member respectively in a diagonal direction to said second and first transverse members respectively, each said diagonal and transverse members having coplanar bottom surfaces and being fixed one with the other at locations where said diagonal and/or transverse members intersect.

8. The mortarless wall structure as defined in claim 1, comprising a plurality of said block spacer members positioned so that said frontal support members are arranged one after another along a length of said lower tier with opposing first and second ends of laterally adjacent pairs of said frontal support members facing one another, each said frontal support member including engagement means interconnecting said first end of one said frontal support member and said second end of said frontal support member laterally adjacent thereto for interlocking each said laterally adjacent pair of said frontal support members one with the other to enclose a horizontal joint formed between said upper and lower tiers.

9. The mortarless wall structure as defined in claim 8, wherein said engagement means comprises a slot formed in said first end of each said frontal support member and an engagement member protruding from said second end thereof, said slot adapted to receive and lockingly engage said engagement member of said laterally adjacent frontal support member.

10. The mortarless wall structure as defined in claim 8, wherein said locator wall surface of said frontal support member includes a spacer web which projects rearwardly, said spacer web located intermediate said first and second ends of said frontal support member to define a lateral locator position for opposing end faces of said blocks of said upper tier arranged laterally adjacent one with the other to facilitate construction of an overlapping arrangement of said blocks.

11. The mortarless wall structure as defined in claim 10, which includes a plurality of vertical spacer members each having a lower end, an upper end, a front face, a rear face adapted to abut against said front faces of a pair of said laterally adjacent blocks of said upper tier, and a spacer wall projecting rearwardly and adapted to be positioned between said opposing end faces of said pair of said laterally adjacent blocks of said upper tier, said vertical spacer member having first means for securing said lower end to at least a downwardly adjacent one of said frontal support members being positioned between said lower and upper tiers and second means for securing said upper end to at least an upwardly adjacent one of said frontal support members of said block spacer members being positioned on top of said upper tier.

12. The mortarless wall structure as defined in claim 11, wherein said rear face of said vertical spacer member is adapted to be arranged coplanar with said upstanding locator wall surface being positioned downwardly adjacent to said lower end, and said front face of said vertical spacer member is adapted to be arranged coplanar with said front edge of said frontal support member being positioned upwardly adjacent to said upper end.

13. A mortarless wall structure, comprising:

a plurality of blocks arranged end to end in a lateral direction so as to form a lower tier and an upwardly adjacent upper tier of the mortarless wall structure, each said block of said upper and lower tiers having a rear face facing in a rearward direction transverse to said lateral direction and front face facing in a forward direction opposite said rearward direction, said front and rear faces of said block defining a width of each of said upper and lower tiers respectively; and a block spacer system for locating and supporting said blocks having at least one block spacer member, said block spacer member comprising:

a base support member having a first end positioned toward said front face of said blocks of said wall structure in said forward direction, a second end positioned in said rearward direction, a bottom surface positioned on top of at least one of said blocks of said lower tier downwardly adjacent thereto, and a top surface adapted to support at least one of said blocks of said upper tier upwardly adjacent thereto;

a first projection which projects downwardly from said bottom surface of said base support member, said first projection having a surface facing said forward direction for abutting against said rear face of said downwardly adjacent block of said lower tier to prevent at least forward displacement of said base support member when positioned on said lower tier;

an elongate frontal support member at said first end of said base support member having a first end and a second end which are oriented proximate said front face of said downwardly adjacent block of said lower tier when said first projection abuts against said block, said frontal support member having a front surface, a bottom surface and an upstanding locator wall surface disposed forwardly of said adjacent block of said upper tier positioned rearwardly adjacent thereto, said upstanding locator wall facing rearwardly for abutment with said front face of said adjacent block of said upper tier to define a forward locator position for said upper tier so as to offset and prevent forward displacement of said upper tier relative to said lower tier, at least a portion of said bottom surface of said frontal support member extending coplanar from said bottom surface of said base support member, said portion of said bottom surface being disposed on said lower tier.

14. The mortarless wall structure as defined in claim 13, wherein said front surface of said front support member is sloped downwardly in said forward direction to facilitate drainage of precipitation away from said front face of said upwardly adjacent block of said upper tier.

15. The mortarless wall structure as defined in claim 13, wherein said downwardly adjacent block is formed with an inner cavity therein which opens upwardly to form a rear block wall of predetermined width defined by said rear face thereof and a forward facing inner face, said base support member including at least one second projection which projects downwardly from said bottom surface and is disposed forwardly of said forward facing inner face within said inner cavity, said second projection having a surface which faces said rearward direction for abutment against said inner face of said rear block wall and is positioned a spaced apart distance from said first projection so as to permit engagement of said rear block wall therebetween.

16. The mortarless wall structure as defined in claim 13, comprising a plurality of said block spacer members positioned so that said frontal support members are arranged one after another along a length of said lower tier with opposing first and second ends of laterally adjacent pairs of said frontal support members facing one another, each said frontal support member including engagement means interconnecting said first end of one said frontal support member and said second end of said frontal support member laterally adjacent thereto for interlocking each said laterally adjacent pair of said frontal support members one with the other to enclose a horizontal joint formed between said upper and lower tiers.

17. The mortarless wall structure as defined in claim 16, wherein said engagement means comprises a slot formed in said first end of each said frontal support member and an engagement member protruding from said second end thereof, said slot adapted to receive and lockingly engage said engagement member of said laterally adjacent frontal support member.

18. The mortarless wall structure as defined in claim 13, which includes a plurality of vertical spacer members each having a lower end, an upper end, a front face, a rear face adapted to abut against said front faces of a pair of said laterally adjacent blocks of said upper tier, and a spacer wall projecting rearwardly and adapted to be positioned between said opposing end faces of said pair of said laterally adjacent blocks of said upper tier, said vertical spacer member having first means for securing said lower end to at least a downwardly adjacent one of said frontal support members being positioned between said lower and upper tiers and second means for securing said upper end to at least an upwardly adjacent one of said frontal support members of said block spacer members being positioned on top of said upper tier.

19. The mortarless wall structure as defined in claim 18, wherein said rear face of said vertical spacer member is arranged coplanar with said upstanding locator wall surface which is positioned downwardly adjacent to said lower end, and said front face of said vertical spacer member is arranged coplanar with said front edge of said frontal support member which is positioned upwardly adjacent to said upper end.

20. The mortarless wall structure as defined in claim 13, wherein said frontal support member having a front edge defined by said front surface and said bottom surface, said front edge adapted to be positioned forwardly a predetermined distance away from said front face of said downwardly adjacent block of said lower tier to form an overhang.

21. The mortarless wall structure as defined in claim 1, wherein said block spacer member is of a unitary construction.

22. The mortarless wall structure as defined in claim 21, wherein said block spacer member is formed of molded plastic.

23. A block spacer system for locating and supporting a plurality of blocks arranged end to end in a lateral direction so as to form a lower tier and an upwardly adjacent upper tier of a mortarless wall structure, said block spacer system having a block spacer member adapted to be positioned between the upper and lower tiers, comprising:

an elongate base support member having a forward end, a rearward end, a top surface and a bottom surface;

spaced apart first and second projections which project downwardly from said bottom surface of said base support member proximate said rearward end, said first projection having a surface facing in a forward direction, said second projection having a surface facing in a rearward direction opposite said surface of said first projection and being positioned a spaced apart distance forwardly from said first projection so as to define a downward opening block-receiving space between said first projection and said second projection; and an elongate frontal support member which is spaced forwardly of said first and second projections at said first end of said base support member and has a first end and a second end which are oriented so that said frontal support member extends in said lateral direction, said frontal support member having a bottom surface which is disposed coplanar with said bottom surface of said base support member, an upstanding locator wall surface which extends upwardly from said top surface of said base support member and faces rearwardly to define a forward locator position, and a front surface which extends upwardly from said bottom surface of said frontal support member to define a front edge of said frontal support member;

whereby said bottom surface of said base support member is positioned on top of a downwardly adjacent block of the lower tier such that a laterally extending wall of the downwardly adjacent block is received between said first and second projections, the upper tier is positioned on the lower tier with said block spacer member positioned therebetween, and said upstanding locator wall surface faces rearwardly toward a front face of an upwardly adjacent block of the upper tier so as to position the upper tier relative to the lower tier while preventing forward displacement of the upper tier relative thereto.

24. The block spacer system as defined in claim 23, comprising a plurality of said block spacer members arranged laterally side by side with said frontal support members adapted to be arranged one after another in a first horizontal row with opposing first and second ends of laterally adjacent frontal support members facing one another, each said frontal support member including engagement means in communication with said first end of one frontal support member and said second end of said frontal support member laterally adjacent thereto for interlocking each of said laterally adjacent frontal support members one with the other.

25. The block spacer system as defined in claim 24, wherein said engagement means comprises a slot formed in said first end of said frontal support member and an engagement member protruding from said second end thereof, said slot adapted to receive and lockingly engage said engagement member of said laterally adjacent frontal support member.

26. The block spacer system as defined in claim 25, which includes a plurality of vertical spacer members each having a lower end, an upper end, a front face, a rear face and a spacer wall projecting rearwardly from said rear face, said vertical spacer member having first means for securing said lower end to a top portion at least one of said frontal support members when disposed downwardly adjacent thereto and second means for securing said upper end to a bottom portion at least one of said frontal support members of said block spacer members when disposed upwardly adjacent thereto.

27. The block spacer system as defined in claim 26, wherein said rear face of said vertical spacer member is adapted to be arranged coplanar with said upstanding locator wall surface being positioned downwardly adjacent to said lower end, and said front face of said vertical spacer member is adapted to be arranged coplanar with said front edge of said frontal support member being positioned upwardly adjacent to said upper end.

28. The block spacer system as defined in claim 23, including two pairs of said first and second projections, each pair spaced apart from said other pair in said lateral direction so as to define two separated anchoring locations for engaging the rear block wall.

29. The block spacer system as defined in claim 23, wherein said base support member comprises first and second elongate transverse members disposed intermediate said first and second ends of said frontal support member and extending from said frontal support member in said rearward direction and first and second diagonal members extending from proximate said first and second ends of said frontal support member respectively in a diagonal direction to said second and first transverse members respectively, each of said diagonal and transverse members having coplanar bottom surfaces and being fixed one with the other at locations where said diagonal and/or transverse members intersect.

30. The mortarless wall structure as defined in claim 23, wherein said block spacer member is of a unitary construction.

31. The mortarless wall structure as defined in claim 30, wherein said block spacer member is formed of molded plastic.

* * * * *

UNITED STATES PATENT AND TRADEMARK OFFICE

CERTIFICATE OF CORRECTION

PATENT NO. : 5,553,435
DATED : September 10, 1996
INVENTOR(S) : Jon H. Eickhoff

It is certified that error appears in the above-indentified patent and that said Letters Patent is hereby corrected as shown below:

Column 7, line 27; change "downwardly adjacent said" to ---said downwardly adjacent---.
Column 9, line 17; after "and" insert ---a---.
Column 12, line 13; after "portion" insert ---of---.
line 16; after "portion" insert ---of---.

Signed and Sealed this
Eighth Day of April, 1997

Bruce Lehman

*Attest:*

BRUCE LEHMAN

*Attesting Officer*

*Commissioner of Patents and Trademarks*